US008636176B2

(12) United States Patent
Malin et al.

(10) Patent No.: US 8,636,176 B2
(45) Date of Patent: Jan. 28, 2014

(54) LIQUID DISPENSER PINCH VALVE

(75) Inventors: Joel Otto Malin, Plymouth, MN (US); Jerry Tauer, Delano, MN (US); Loren Veltrop, Chicago, IL (US)

(73) Assignee: Prince Castle, LLC, Carol Stream, IL (US)

( * ) Notice: Subject to any disclaimer, the term of this patent is extended or adjusted under 35 U.S.C. 154(b) by 323 days.

(21) Appl. No.: 13/169,305

(22) Filed: Jun. 27, 2011

(65) Prior Publication Data

US 2012/0325859 A1 Dec. 27, 2012

(51) Int. Cl.
*B67D 7/80* (2010.01)

(52) U.S. Cl.
USPC ..... 222/146.6; 222/212; 222/517; 222/529; 222/532; 251/10; 62/396

(58) Field of Classification Search
USPC ..... 251/7, 9–10; 62/389, 391, 393, 396; 222/146.6, 212–214, 391, 323–324, 222/469–474, 517, 527–532
See application file for complete search history.

(56) References Cited

U.S. PATENT DOCUMENTS

| | | | | | |
|---|---|---|---|---|---|
| 2,806,482 | A | * | 9/1957 | Norris et al. | 137/376 |
| 2,808,185 | A | * | 10/1957 | Norris et al. | 222/556 |
| 2,876,937 | A | * | 3/1959 | Wilson | 222/529 |
| 4,651,898 | A | * | 3/1987 | Bell | 222/129 |
| 5,114,045 | A | * | 5/1992 | Herpe | 222/105 |
| 5,265,772 | A | * | 11/1993 | Bartasevich et al. | 222/214 |
| 5,340,211 | A | | 8/1994 | Pratt | |
| 5,797,519 | A | | 8/1998 | Schroeder et al. | |
| 5,862,956 | A | * | 1/1999 | Brandenburg et al. | 222/214 |
| 5,921,440 | A | | 7/1999 | Maines | |
| 6,186,361 | B1 | | 2/2001 | Teetsel, III | |
| 6,253,957 | B1 | | 7/2001 | Messerly et al. | |
| 6,497,343 | B1 | | 12/2002 | Teetsel, III | |
| 6,502,724 | B1 | * | 1/2003 | Kelpach | 222/146.6 |
| 6,626,332 | B2 | * | 9/2003 | Ehrensperger et al. | 222/190 |
| 6,659,311 | B2 | | 12/2003 | Prueter | |
| 6,792,966 | B2 | | 9/2004 | Harvey | |
| 7,337,920 | B2 | | 3/2008 | Duck et al. | |
| 7,360,672 | B2 | * | 4/2008 | Sweeton | 222/383.1 |
| 2004/0031813 | A1 | * | 2/2004 | Gates | 222/105 |
| 2007/0192981 | A1 | | 8/2007 | Lawshe | |
| 2007/0267446 | A1 | | 11/2007 | Pressler | |
| 2008/0302822 | A1 | * | 12/2008 | Tetreault et al. | 222/146.6 |
| 2009/0250491 | A1 | | 10/2009 | Erman et al. | |
| 2010/0065587 | A1 | | 3/2010 | Erman et al. | |

OTHER PUBLICATIONS

Pinch Valve Semantics, David Gardellin, President of Onyx Valve Co.; available at www.onyxvalve.com.

(Continued)

*Primary Examiner* — Paul R Durand
*Assistant Examiner* — Andrew P Bainbridge
(74) *Attorney, Agent, or Firm* — Kelly & Krause, LP; Joseph P. Krause

(57) ABSTRACT

A two-piece pinch valve is disclosed. A first piece or part of the valve is fixedly installed into a dispensing cabinet. A second piece or part having a movable pinch bar that pinches and un-pinches a tube is installable into and removable from the first piece by hand. Removal of the second piece from the first pieces allows a tube to be directly installed into the pinch valve. Installation of the second piece into the first piece configures the valve for operation. The second piece is installed into slots in the first piece. The slots and engaging protuberances on the second piece enable the second piece to be locked in place.

13 Claims, 12 Drawing Sheets

(56) References Cited

OTHER PUBLICATIONS

Silver King®, Majestic Series Milk Dispensers specification sheet FNSKMAJ09, 2009.

Silver King® Cream Dispenser, Model SKMCD1P, equipment manual for McDonald's Corporation®, 2005.

Silver King® Portion Control Cream Dispensers calibration sheet.

SureShot® Dispensing Sytems,SureTouch Refrigerated Liquid Dispensers Operations Manual, A.C. Dispensing Equipment, Lower Sackville, Nova Scotia Canada.

SureShot® Dispensing Systems, Dairy Dispenser Valve Assembly Cleaning Instructions, A.C. Dispensing Equipment Lower Sackville, Nova Scotia Canada.

SureShot® Dispensing Systems, Advance Portion Controlled Refrigerated Liquid Dispensers specification sheet, A.C. Dispensing Equipment, Lower Sackville, Nova Scotia Canada, Jan. 2011.

SureShot® Dispensing Systems, Suggested Preventive Maintenance Checklist for Refrigerated Liquid Dispenser, A.C. Dispensing Equipment, Lower Sackville, Nova Scotia Canada, Sep. 2006.

SureShot® Dispensing Systems, SureShot sugarshot, granular sugar dispensers parts catalogue, A.C. Dispensing Equipment, Lower Sackville, Nova Scotia Canada.

SureShot® Intellishot Dispensing System Specification; A.C. Dispensing Equipment Inc., Sep. 2007.

Fluid Mechanics, Fundamentals and Applications; Yunus A. Cengal and John M. Cibal; chapter 12: Radiation Process and Properties, McGraw Hill, Higher Education, copyright 2006.

Fundamentals of Fluid Mechanics Fifth Edition; Bruce R. Munson, Donald F. Young, and Theodore H. Okiishi; copyright 2006.

The Heinz Guide to Condiment Dispensing Equipment; Heinze Foodservice.

SureShot® Flexoshot, A.C. Dispensing Equipment Inc., Lower Sackville, Nova Scotia Canada, Sep. 2007.

Silver King® Technical Manual, Model SKNES2B/3B.

* cited by examiner

LIQUID DISPENSER PINCH VALVE

BACKGROUND

A pinch valve is a valve that is operable with a flexible tubing or hose and which is capable of pinching the tube or hose using a tube-pinching mechanism. Pinch valves are typically full bore, linear action valves that can be used in an off/on manner. However, some pinch valves can be used in a variable position or throttling service.

Pinch valves are used in many medical and pharmaceutical applications. They are also used in food dispensing applications because advantages of pinch valves include cleanliness, excellent drainage, and ease of cleaning. In addition to cleanliness, another advantage of pinch valves is their operation speed. Most pinch valves are simply on-off valves; they open and close a flexible tube using a pinch bar that moves between two positions. Moving a pinch bar through two, fixed locations can be done quickly.

A problem with prior art pinch valves, especially those used with a liquid dispenser is that they do not facilitate the installation and removal of the bulk containers from which liquids are dispensed. Stated another way, prior art pinch valves typically require disassembly to install and/or remove a tube passing through them and also for cleaning. Disassembling a prior art pinch valve is difficult and time consuming. A pinch valve that can be disassembled quickly and easily would be an improvement over the prior art.

DETAILED DESCRIPTION

Figure 1:
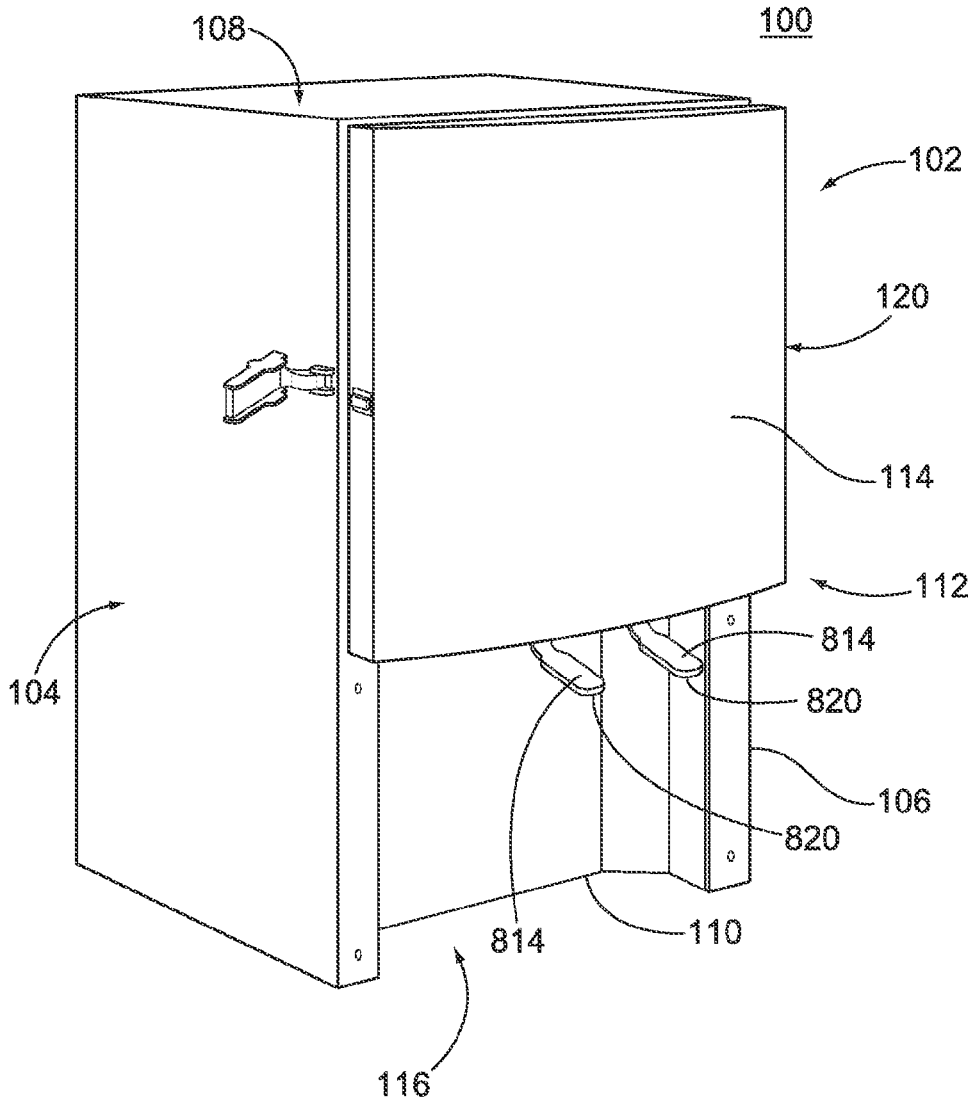
FIG. 1 is a perspective view of a dispenser for liquids.

FIG. 1 is a perspective view of a refrigerated liquid dispenser 100. The dispenser 100 is comprised of a cabinet 102 having a left side 104, a right side 106, a top 108, a bottom 110 and a front side 112. The front side 112 is comprised of a door 114 attached by a hinge (not visible in FIG. 1) to the right side 106 of the cabinet 102. Refrigeration equipment comprised of a compressor, condenser and a fan are enclosed inside a refrigeration equipment compartment 116 located below a refrigerated storage compartment 120, which is located behind the hinged door 114.

Figure 2:
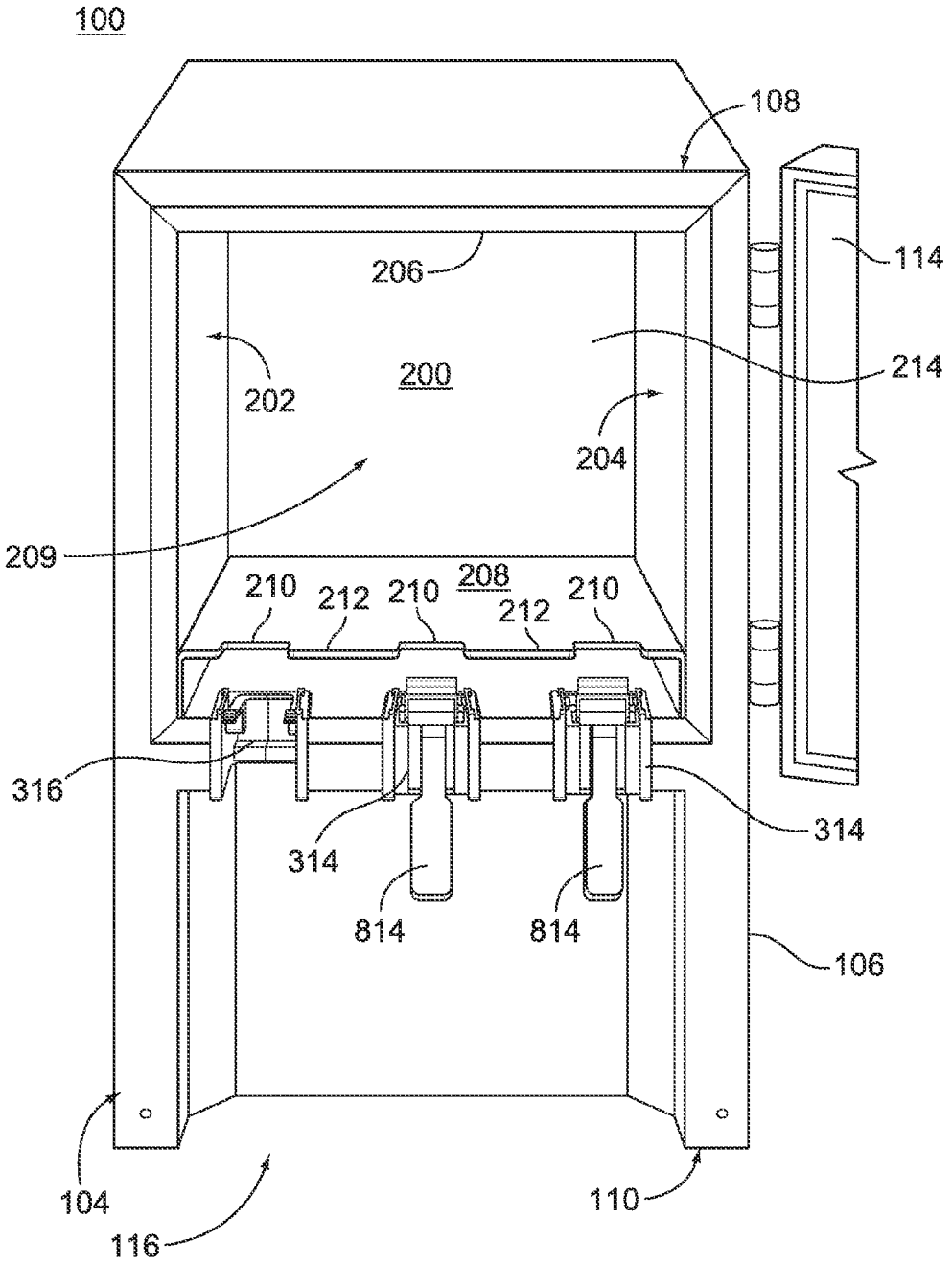
FIG. 2 is a front elevation view of the liquid dispenser.

FIG. 2 is a front elevation view of the liquid dispenser 100 with the door 114 open to reveal the inside of the refrigerated storage compartment 200. The refrigerated storage compartment 200 has a left side 202, a right side 204, a top 206, a bottom 208 and a rear panel 209. The sides, top and bottom are thermally insulated. The insulation is not shown but well-known to those of ordinary skill in the art and further discussion of it is omitted for brevity.

The bottom 208 of the refrigerated storage compartment 200 has a front edge 212 into which slots 214 are formed. The slots 214 receive pinch valves described below. The pinch valves are comprised of two pieces. A first part is fixed in a slot 214. The second part of the pinch valve is removable from the first part in order to allow a flexible tube extending downwardly from a liquid storage bin in the refrigerator storage compartment 200 to be received directly into the first part of the valve wherein the tube is pinched and un-pinched.

Figure 3A:
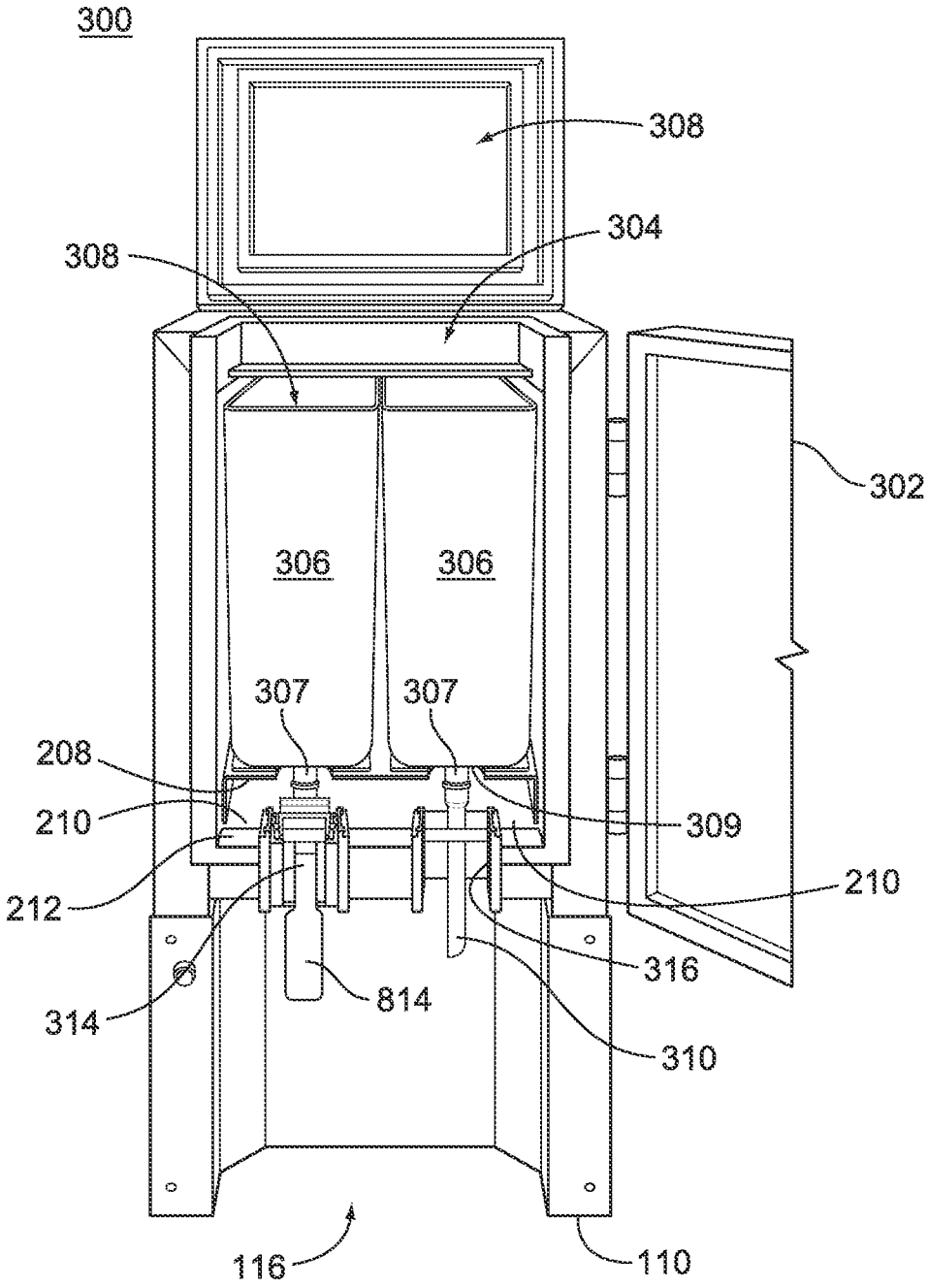
FIG. 3A is a front elevation view of a liquid dispenser, the door of which is removed.

FIG. 3A is a front elevation view of a liquid dispenser 100, the door 114 of which is removed to reveal a refrigerated compartment 300 having two liquid storage tanks 302 side-by-side in the compartment 300. The top 301 is hinged to a back side of the cabinet 102 to allow tanks 302 to be refilled without having to remove them from the compartment 200.

The tanks 302 shown in FIG. 3A are known in the art. They are plastic, substantially rectangular in shape and with an open top 304 into which liquid can be poured. The tanks have bottoms 309 with openings, not visible in FIG. 3A but from which flexible plastic tubes 310 extend downwardly from short and relatively rigid cylinders. The tube from the left-side tank 302 is shown passing through an assembled pinch valve 314. The tube from the right-side tank 302 is shown passing through the aforementioned first part 316 of the pinch valve, i.e., the second part of the valve is removed.

Controllably dispensing liquid from the tanks 302 requires the flexible plastic tubes 310 to be opened and closed. Opening and closing the flexible tubes 310 is accomplished using a pinch valve 314, which is considered herein to be a full bore control valve that uses a pinching effect to obstruct fluid flow.

A problem with many prior art pinch valves is that they require a tube to be threaded through the valve. Threading a tube through a pinch valve means passing the flexible tube through a pinch valve in a manner akin to inserting a strand through a small opening. Threading a tube through a prior art pinch valve usually requires manipulating the tube through the valve from the top by bending folding. It is time consuming, tedious and usually requires supporting a relatively heavy, liquid-filled container.

Figure 3B:
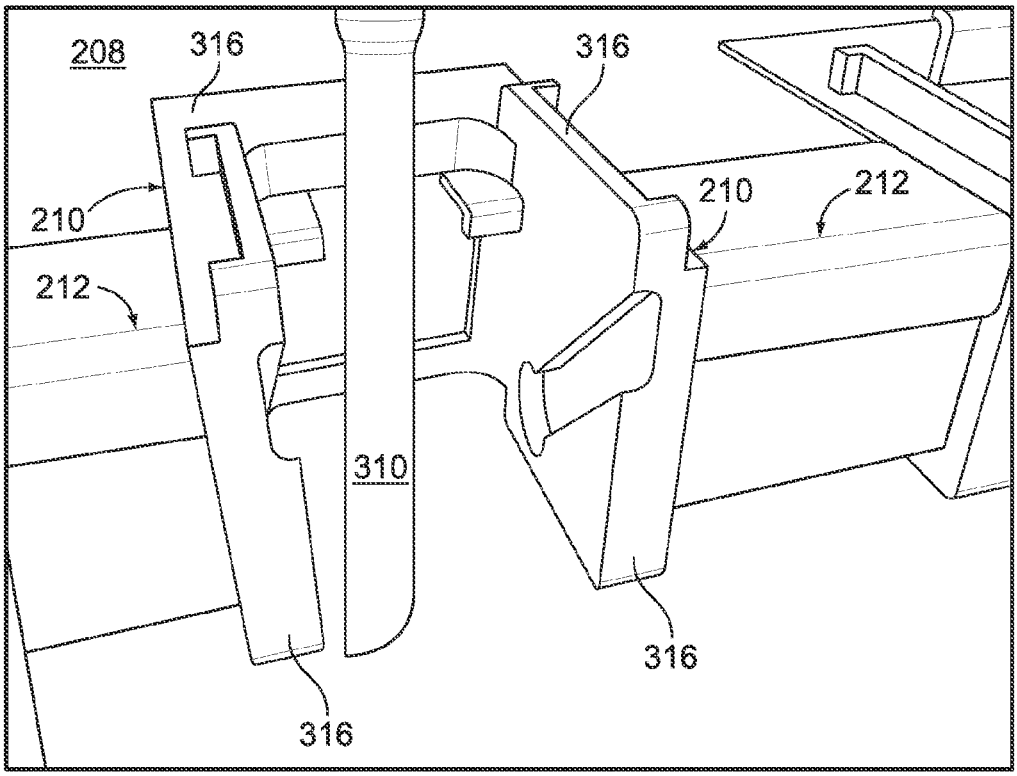
FIG. 3B is a perspective view of a dispensing tube inserted into the first part of the pinch valve.

The pinch valve 314 disclosed herein is comprised of two sections or portions that can be quickly and easily separated from each other without tools or special equipment in order to enable a dispensing tube 310 to be inserted directly into the "valve," i.e., without having to feed or thread a tube through the valve 314. FIG. 3B shows a dispensing tube 310 from a tank inserted into a substantially U-shaped first part of the valve 314, which is preferably fixed into a slot 210 formed in the front edge 212 of the bottom 208 of the refrigerated compartment using an adhesive.

The first part of the valve 314 is referred to herein as a frame section 316. When viewed from above or below, the frame section has a shape reminiscent of the upper case Arabic letter "U." Its shape is also reminiscent of the Greek letter "Π" which is also known as "pi." When viewed from above or below, its shape is also reminiscent of the mathematical symbol for intersection (∩) and union. A second section that is removable from the frame section 316 is referred to as a removable clamp section. The clamp section is described below. For brevity, such shapes (∩, U, Π) and equivalents thereof are collectively referred to hereinafter as U-shaped or substantially U-shaped.

Figure 4:
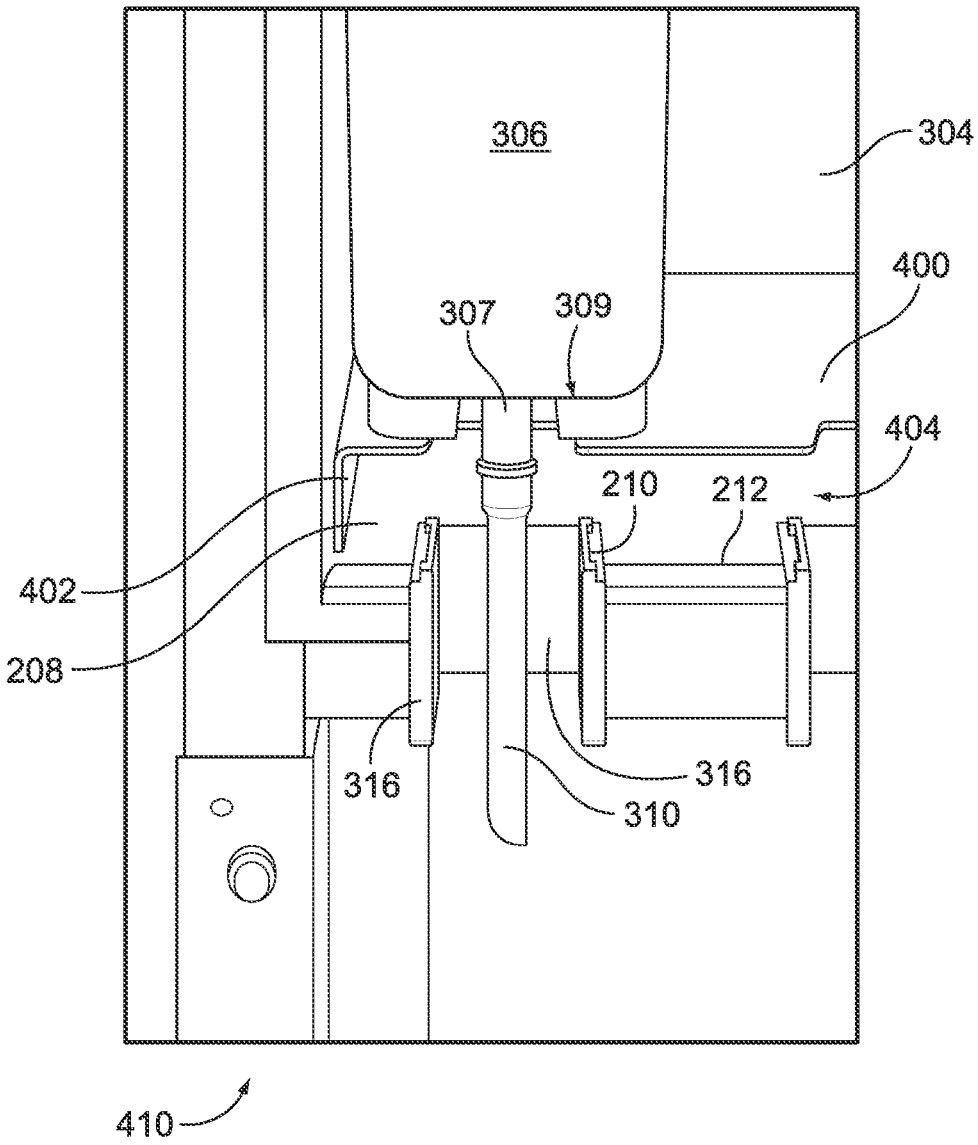
FIG. 4 is a close-up view of a refrigerated liquid dispenser compartment and depicting how the tank is placed directly into the compartment.

FIG. 4 depicts a tank 306 in the compartment 300 and its associated flexible tube 310 descending downward after being placed directly into the first part 410 of the pinch valve 314. The tube 310 can be seen in its entirety, extending, downwardly from the bottom 309 of the tank 306 a distance of between about six and about ten inches. FIG. 4 also shows that there is no structure or mechanism through which the tube 310 needs to be placed or threaded. The tube is simply placed into a substantially U-shaped frame portion or section 316. The frames section 316 is considered herein to be a first part of the pinch valve 314.

The bottom 309 of the tank 306 rests on a support plate 400. The support plate 400 has a side wall 402 that defines an air gap 404 below the support plate 400 and above the bottom 208 of the storage compartment 200. The notch 210 formed at the front edge 212 of the bottom 208 is configured to receive the pinch valve assembly that is comprised of the aforementioned U-shaped frame section 316, which receives a clamp section that is removable from the frame section 316.

Figure 5:
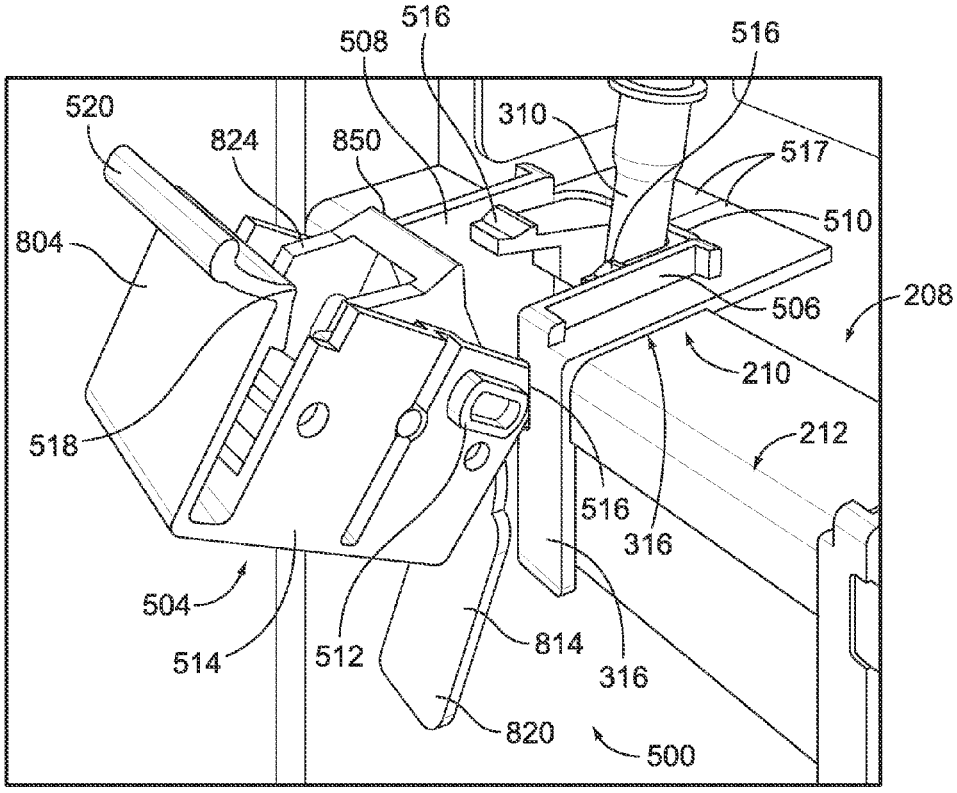
FIG. 5 is a perspective view of the clamp section of the pinch valve.

FIG. 5 is a perspective view of the clamp section 504, shown removed from the frame section 316 and inclined at an angle relative to the horizontal bottom surface 208 of the refrigerated storage compartment 200. The frame section 316 is considered herein to be comprised of two opposing and substantially parallel sides 506 and 508, which are spaced-apart from each other by what is considered herein to be a third side 510 extending between the two opposing sides 506 and 508.

When the clamp section 504 is held at an angle as shown, protuberances 512 that extend outwardly from sides 514 of the frame section 316 can be slid into two, opposing grooves 516 formed into the opposing sides 506 and 508 of the frame section 316. The removable clamp section 504 is slid down the grooves 516 to a substantially circular cutout located near the bottom of the U-shaped frame section sides 506 and 508. The cutout is identified by reference numeral 618 in FIG. 6A. When the protuberances reach the cutout 618, the frame section 504 can be rotated forwardly, i.e., toward the tube 310.

Cantilevered arms 516 extend from the third side 510 of the frame section 316. They are configured to engage an edge 518 of a clamp 520 located at the top 804 of the clamp section 504. When the clamp section 504 is slid down the grooves 516 to the cut-out 618 and when the clamp section 504 is rotated forwardly, the arms 516 and clamp 520 lock the clamp section 504 in place in the frame section 316.

In a preferred embodiment, the third side 510 of the frame section 316 is formed by wide, base section portions of the first side 506 and the second side 508. As stated above, both of the sides of the frame section have a slot formed in them to receive the clamp section, which is also referred to herein as a second part of the pinch valve.

The slot 618 formed into each side of the frame section 316 that receives a protuberance extending from a side of the clamp section 504 is referred to herein as a clamp receiving slot 618. The clamp-receiving slot 618 in the first side of the U-shaped frame section 316 faces or opposes a clamp-receiving slot in the opposite second side of the U-shaped frame section 316. The clamp-receiving slots 618 in the sides of the frame section 316 enable the clamp section 504 to be slid upwardly and removed from the frame section 316 and thereafter slid downwardly for re-installation into the frame section 316. The ability to quickly and easily remove the clamp section 504 from the frame section 316, without tools, enables a dispensing tube 310 to be placed into and removed from the pinch valve frame section 316 directly, i.e., without having to thread or feed a tube 310 through a pinch bar mechanism as prior art pinch valves require.

A dispensing tube 310 is removed from the pinch valve by de-latching the clamping arms 516 from the edge 518 of the clamp 520 and rotating the clamp section 504 outwardly, i.e., away from the tube 310 and refrigerated compartment 220 and sliding the clamp section 504 upwardly and out of the clamp receiving slots 516. After the clamp section 504 is removed from the frame section 316, a tube in the frame section 316 can be removed directly from the frame section 316 because the frame section 316, being U-shaped, has an open passageway between the two opposing side walls 506 and 508.

The first side 506, second side 508 and third side 517 of the frame section 316 are considered herein as being substantially U-shaped, i.e., they have a shape reminiscent of the Arabic letter "U." The open space between the two opposing sides and "in front of" the third side defines an open passageway that receives a tube 310 of a liquid container.

Figure 6A:
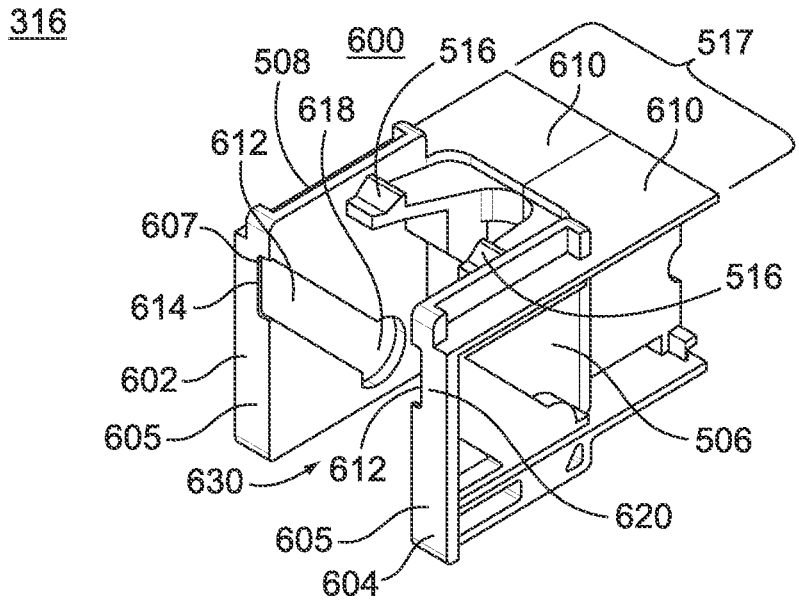
FIG. 6A is a perspective view of the frame section of the pinch valve.
Figure 6B:
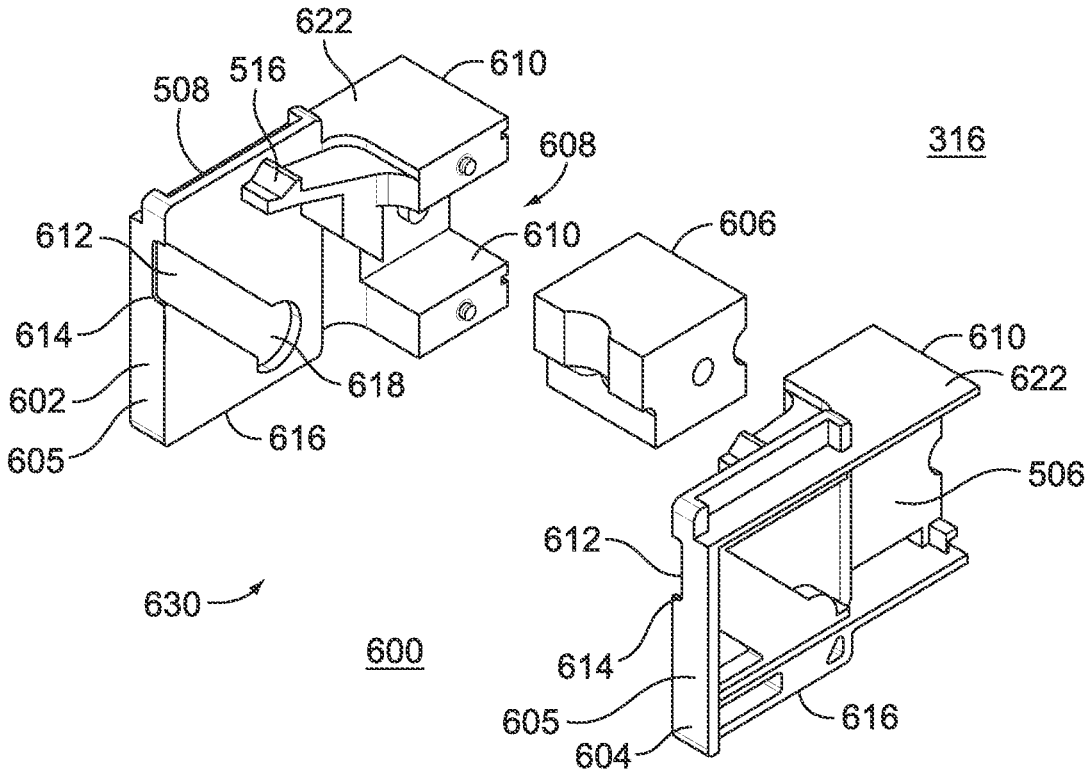
FIG. 6B is an exploded view of the frame section of the pinch valve.

The frame section depicted in FIG. 5 is actually an assembly of three separate components shown in FIGS. 6A and 6B. FIG. 6A is a perspective view of a frame section 600 assembled. FIG. 6B is an exploded view of the frame section 600 depicted in FIG. 6A.

Referring to both FIGS. 6A and 6B, the frame section 600 is comprised of a left side or portion 602, an opposing left side or portion 604 and a thermally-conductive body 606 enclosed by end sections 622 of the left portion 602 and right portion 604. The thermally-conductive body 606 conducts heat. It is referred to hereinafter as a heat sink for brevity because its function is to carry heat away from (sink) a flexible tube in the pinch valve. In an alternate embodiment, however, wherein liquid in a tube 310 is to be kept warm or hot, the thermally-conductive body 606 carries heat toward a flexible tube in the pinch valve but is nevertheless still considered to be a heat sink.

Referring now to FIG. 6B, both sides 602 and 604 have a base portion or section 622 having a horizontally-oriented notch 608 the horizontal side walls 610 of which are separated from each other by a vertical distance great enough to receive the heat sink 606 between them. A front face 605 opposite the base portion 622 is formed with an opening 614 into a clamp-receiving slot 612 formed into the left side portion 602 and right side portion 604.

The clamp-receiving slot 612 receives protuberances that extend outwardly from the sides of the aforementioned removable clamp section 504. The clamp-receiving slot 612 has a width dimension (orthogonal to the length of the clamp-receiving slot 612) and a depth into the sides of the clamp sections. The width and depth of the clamp receiving slot 612 are selected to provide a slip fit to a substantially rectangular protuberance 512 from the side wall 514 of a clamp section 504. The clamp receiving slot 612 thus receives the clamp section 504 into the frame section 316.

As shown in FIG. 6B, the clamp receiving slots 612 have an opening 614 at the front faces 605 of both the left side 602 and right side 604. The slots 612 angle downwardly from the opening 614 and terminate at substantially circular receiving holes or cut outs 618 located at what is considered to be the bottom of the clamp-receiving slot, which is also near the bottom 616 of the left side 602 and the bottom 616 of the right side 604.

(The right side 604 of the frame section 600 is a mirror image of the left side 602. When the left side 602 and right side 604 are assembled as shown in FIG. 6A, the right side 604 has a clamp receiving slot and cut out directly opposite the clamp receiving slot 612 and cut out 618 formed in the left side 602. Only the opening 620 of the clamp receiving slot 612 formed into the right side 604 is visible.)

When the left side 602 and the right side 604 are assembled together with the heat sink 606 enclosed between them, the assembled frame section 600, which is depicted in FIG. 6A, can be seen to have two opposing and spaced apart sides 602 and 604 and a third side 623 formed in part by the heat sink 606 enclosed within the slots or notches 608 therein. The side walls 610 of the notch 608 and the heat sink 606 thus form the third side 623 of the U-shaped frame section 600. The horizontal separation distance between the opposing sides 602 and 604 defines an open passageway 630, which is the open space between the opposing and spaced apart side walls 602 and 604 and in front of the third wall or side 623.

Figure 7A:
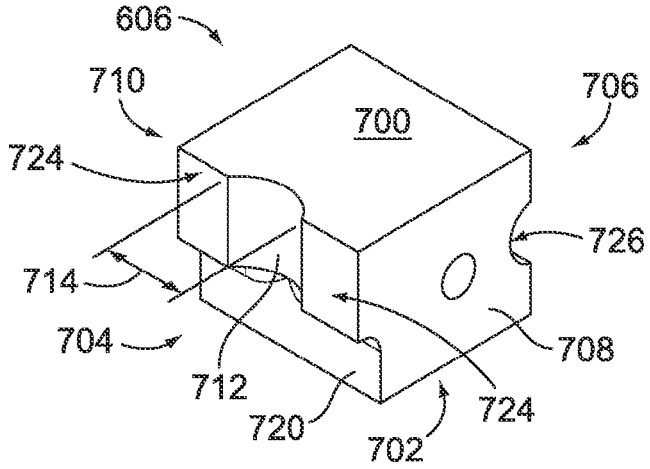
FIG. 7A is a perspective view of the latch.

FIG. 7A is a perspective view of the heat sink 606. The heat sink 606 is made of a thermally-conductive material, examples of which include aluminum, copper or brass. The heat sink has a top surface 700 a bottom surface 702 opposite the top surface 700, a front face 704, which when installed into the clamp section 504 abuts a flexible tube 310, a rear face 706 opposite the front face 704, a right side 708 and a left side 710.

Figure 7B:
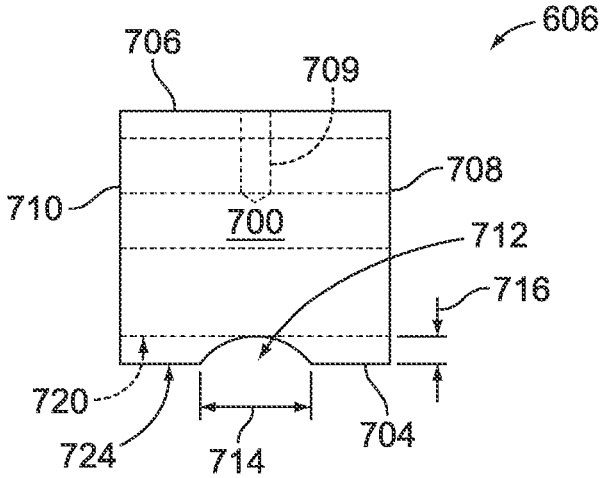
FIG. 7B is a top view of a heat sink in the pinch valve frame section.

FIG. 7B is a top view of the heat sink 706. The right side 708 and left side 710 can be seen in FIG. 7B as substantially planar. The front face 704, however, has a channel 712 sized to receive a tube 310. In one embodiment the channel 712 has a cross sectional shape (when viewed from the top) which is an arc of a circle. In another embodiment the channel 712 is an arc of an ellipse. The channel 712 has a width 714 and a depth 716 sufficient to receive a flexible tube 310 that extends from a liquid holding tank 302 and which tends to locate or fix a tube 310 into the center of the frame section 316. An advantage of having a channel 712 formed into the front face over a flat surface is that a tube 310 located into the channel 712 will tend to stay in the channel 712 while the tube 310 is being pinched and un-pinched.

Figure 7C:
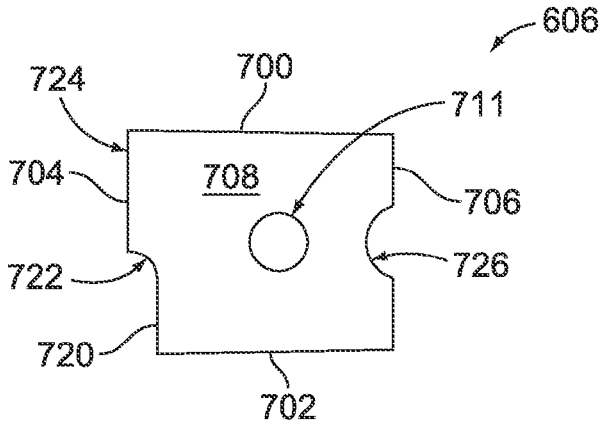
FIG. 7C is a right-side view of a heat sink in the pinch valve frame section.

FIG. 7C is a right-side view of the heat sink 606. The top face 700 and the bottom face 702 can be seen to be substantially planar. The front face 704 has a second and recessed lower front face 720, that is substantially vertical, substantially planar and setback into the body of the heat sink 606 from the upper front face 724 by a distance substantially equal to the depth 716 of the channel 712. The extended face or projecting face 724 transitions to the recessed face 720 by a chamfer 722. The recessed lower front face 720 is the surface against which a pinch bar in the clamp part of the pinch valve 314 exerts a compressive, pinching force on the flexible tube resting in the channel 712.

The back face 706 of the heat sink 606 has a second, horizontally-oriented channel 726. The cross sectional shape of the second channel 726 (when viewed from either side) is either an arc of a circle or an arc of an ellipse. The second channel 726 has a depth and a width configured to mate with the outside surface of a length of tubing of a refrigeration system evaporator coil, not shown but well known to those of ordinary skill in the mechanical art. The mechanical attachment of a refrigeration coil into the second channel 726 provides a direct thermal mechanical coupling of the heat sink 606 to an evaporator coil of a refrigeration system. In another embodiment, the back face 706 is smooth and has attached to it, the cold side of a Peltier device. In another embodiment, the channel 726 formed in the back face 706 has an electric heating element attached to it, which provides heat energy into the heat sink 606. In yet another embodiment, the channel 727 has a tube through which a hot or heated liquid is passed and which provides heat energy into the heat sink. In yet another embodiment, a smooth back face 706 has the hot side of a Peltier device attached to it, which also provides heat energy into the heat sink 606. Regardless of whether the heat sink back face 706 is attached to a source of heat energy or a heat sink, the direct, mechanical coupling of the heat sink 606 to a heat transfer device, such as an evaporator coil, a Peltier device, or a heating element, significantly improves heat transfer to and from liquids in a flexible tube 310 that abuts the front face 704 and which is held in the first channel 712. The shape of the first channel being substantially similar to the shape of a tube 310 increases the surface areas of the tube 310 and heat sink 606 through which heat can be conducted.

Figure 8A:
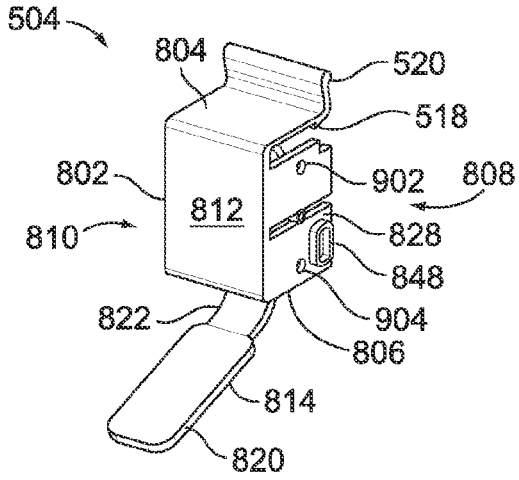
FIG. 8A is a perspective view of a preferred embodiment of a removable clamp part of the pinch valve.
Figure 8B:
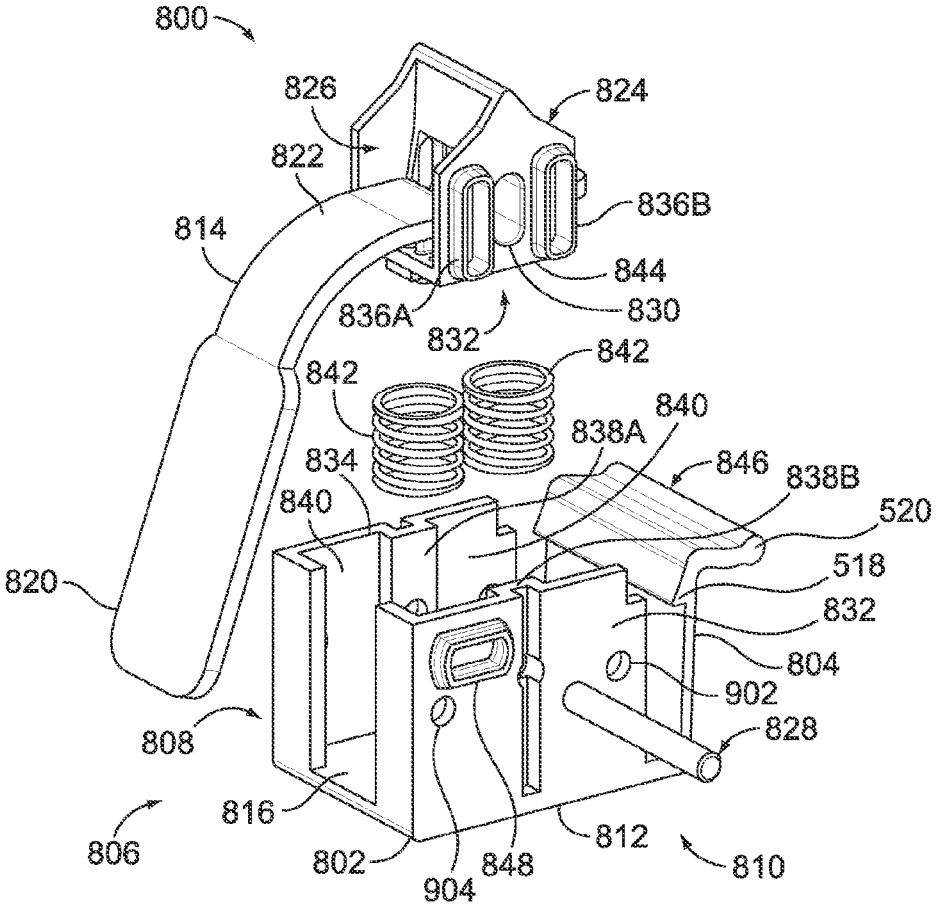
FIG. 8B is a perspective view of the clamp body and pinch bar.

FIG. 8A is a perspective of a preferred embodiment of a removable clamp part, renumbered in FIGS. 8A and 8B starting with reference numeral 800. The clamp part 800 depicted in FIG. 8 is identical to the clamp part identified by reference numeral 504 in FIG. 5 and which is shown in FIG. 5 as ready for removal from, or insertion into, the clamp portion 502.

In FIG. 8A, the clamp part 800 is comprised of a clamp body 802 the shape of which is reminiscent of a rectangular parallelepiped or cuboid. One side of the cuboid-shaped clamp body, which is not visible in FIG. 8A, is open. The open side of the clamp part 800 is best seen in FIG. 8B, wherein the clamp part 800 is depicted with the open side facing upwardly.

Referring now to both FIGS. 8A and 8B, the clamp body has a top side 804 a bottom side 806 a right side 808 and a left side 810, not visible in FIG. 8A. A front side 812 faces an operator of the valve when it is installed in the refrigerated cabinet.

A curved handle 814 extends downwardly from the bottom side 806. The bottom side 806 is thus formed with a slot, which the handle 814 projects outwardly from and translates in. The handle 814 has a bottom end 820 and an opposing top end 822. The curvature of the handle 814 allows the top end 822 to extend into an open side 826 of a wedge-shaped pinch bar 824 with the bottom end 820 extending away from the cabinet facilitating actuation of the valve by lifting or depressing the handle 814.

The top end 822 of the handle 814 is mounted into a pyramidal or wedge-shaped pinch bar 824 using a pin 828 that extends through the right side 808 and the left side 810 of the clamp body 802. The pin 828 also extends through an elongated slot 830, which extends through the right side 832 of the pinch bar 824 and the left side 834 of the pinch bar 824.

The elongated slot 830 can be seen as bordered by two substantially cuboid-shaped protuberances 836A and 836B extending outwardly from the right side 832 of the pinch bar 824. An identical set of protuberances extend from the left side 834 but cannot be seen in FIG. 8B. The protuberances 836A and 836B are separated by a distance slightly greater than the width of two cuboid extensions 838A and 838B, which extend from the left interior side 810 and the right interior side 808 of the clamp body 802, i.e., into the open interior space 840 of the clamp body 802.

With regard to the clamp body 802 and more particularly the pinch bar 824, the distance separating the left side 834 from the right side 832 of the clamp body 824 is less than the separation distance between the left side 810 and the right side 808 of the clamp body 802. The pinch bar 824 is thus able to freely translate back and forth (as shown in FIG. 8A) or up and down as shown in FIG. 8B responsive to bias exerted on the bottom face 844 of the pinch bar 824 by two coil springs 842. The springs 842 bias the pinch bar 824 outwardly from the interior space 840 of the clamp body 802, which is toward the lower flat face 720 of the heat sink 606.

The pinch bar 824 translates back and forth on a track or slide comprised of the protuberances 836A and 836B that extend outwardly from the opposite sides of the pinch bar 824. The protuberances 836A and 836B ride against the side walls of the cuboid extensions 838A and 838B from the left and right sides 810 and 808 of the clamp body 802.

The pin 828, which also extends through the elongated slot 830, provides a pivot for the top end 822 of the handle 814. Upward or downward movement of the bottom end 820 of the handle 814 drives the pinch bar 824 backwardly, against the force exerted on the pinch bar 824 by the springs. Upward or downward movement of the bottom end 820 of the handle 814 thus causes the pinch bar 824 to be retracted inwardly into the clamp body releasing or un-pinching a hose 310 in the frame portion.

Figure 8C:
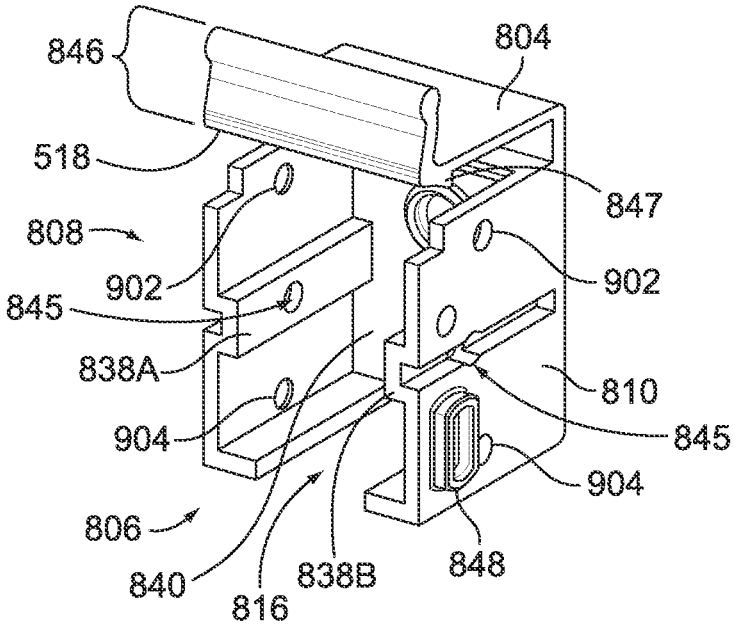
FIG. 8C is a perspective view of the open interior of the clamp body.

FIG. 8C is a perspective view of the open interior 840 of the clamp body 802. The open slot 816 in the bottom face 806 described above and which accommodates vertical translation of the handle is visible in FIG. 8C as are the protuberances 838A and 838B that extend inwardly from the left side 810 and right side 808 of the clamp body 804.

A hole 845 through the two opposite sides is sized and configured to receive the pin 828 around which the top end 822 of the handle 814 pivots. A clamp 846 with an edge 847 is formed at the top 804 of the clamp body 802, extending upwardly from the top side 804 to provide a latch for cantilevered arms that extend from the third side of the U-shaped clamp portion.

FIG. 8C shows one of two substantially rectangular-shaped protuberances 848 located near the open side of the cuboid-shaped clamp body 802, away from the front face 812 and close to the bottom face 806. The protuberances 848 are dimensioned to slide freely into the clamp receiving slots 612 described above and shown in FIGS. 6A and 6B. The rectangular shape of the protuberances 848 allows them to slide up and down the slots 612. When the protuberances 848 are rotated in the aforementioned cut-outs 618, their rectangular shape precludes them from sliding out of the clamp receiving slots 612.

The protuberance length is less than the diameter of the cut-out 618 formed at the bottom of the clamp receiving slot. The protuberance length is chosen such that when the protuberances 848 are inside the cut out 618 and rotated by even a small angle, as happens when the clamp body is latched into place, the protuberance length prevents the clamp body 802 from sliding upwardly, i.e., out of the frame section. Rotation of the clamp body 602 in the frame section to a latched position thus locks the clamp body into the frame section.

Figure 8D:
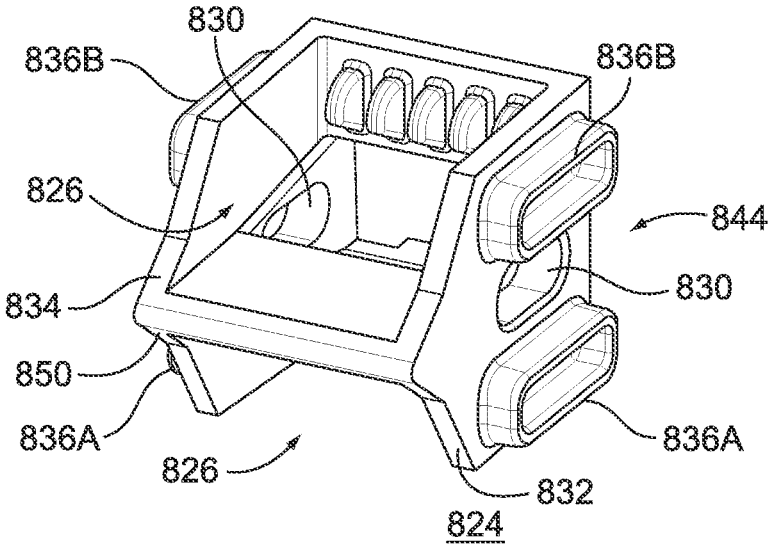
FIG. 8D is a perspective view of the pinch bar viewed from the apex ridge.
Figure 8E:
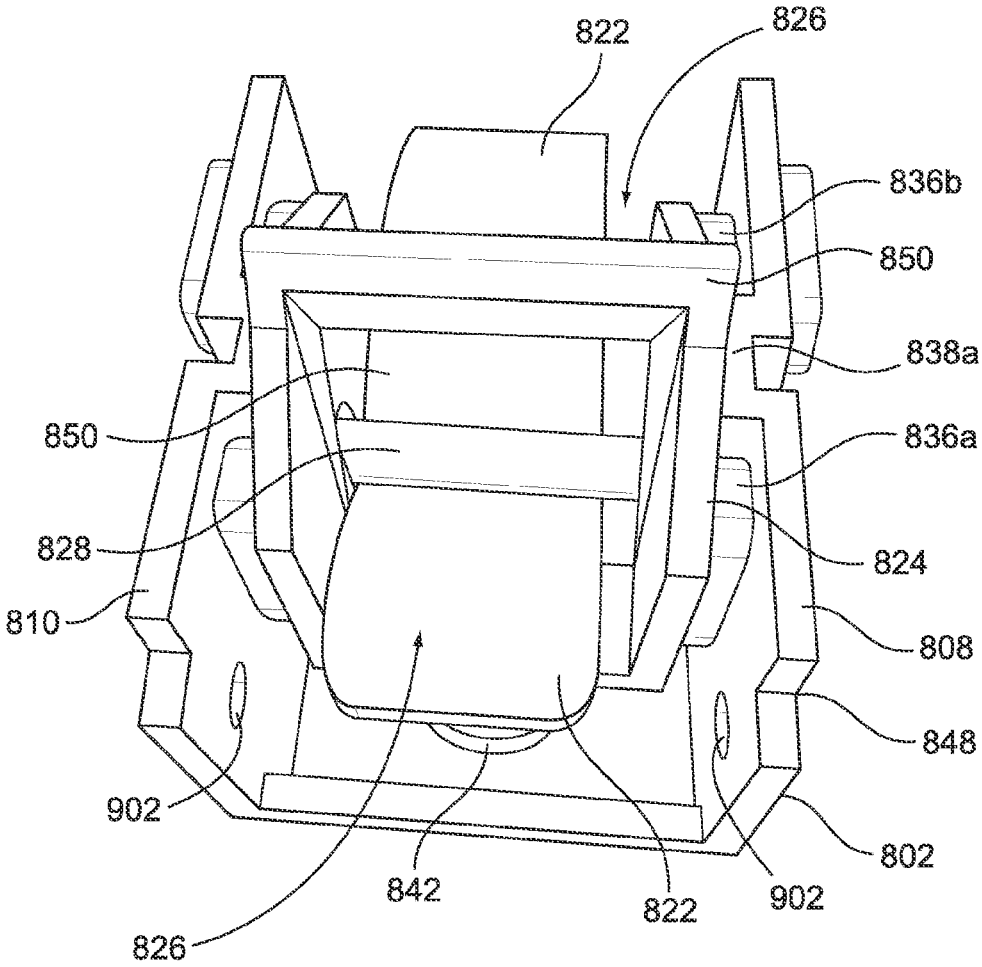
FIG. 8E is a perspective view into the open sides of the pinch bar.

FIG. 8D is a perspective view of the substantially wedge-shaped pinch bar 824 viewed from the apex edge 850. The elongated slot 830, which rides over the pin 828, extends through both the left side 834 and the right side 832. The substantially rectangular-shaped protuberances 836A and 836B that extend outwardly from the sides can define a slot 830 between the two protuberances 836A and 836B.

Figure 9:
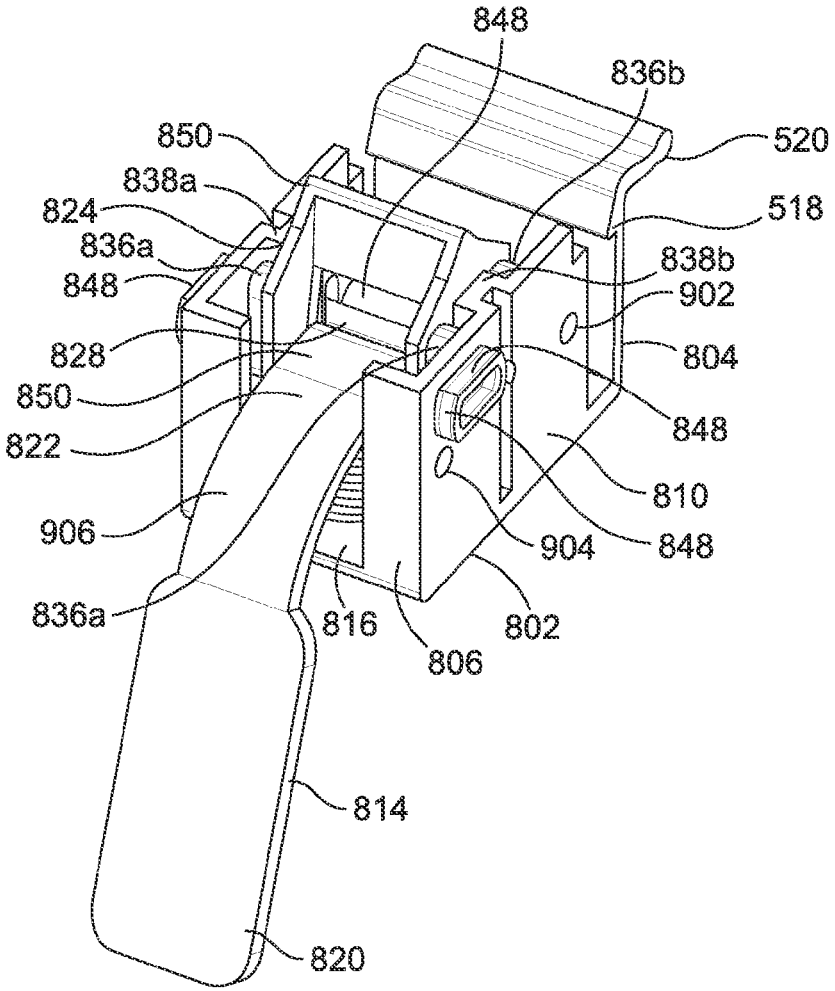
FIG. 9 is a perspective view of the assembled clamp section.

FIG. 9 is a perspective of the assembled clamp section, viewed from the top of the open side of the clamp body 802. A pair of holes 902 are formed into the opposing sides 808 and 810 of the clamp body to receive optional roll pins, not shown. The function of this feature is to limit the travel of the lever 814 to one direction. A similar pair of holes 904 located below the pin 828 can receive a second stop pin (not visible) the function of which is to limit the travel of the handle in an opposite direction. Insertion of a pin through the upper holes 902 or lower holes thus limits the travel of the lever to only an upwardly or downwardly direction. A pin through either pair of holes 902 and 904 preventing the top surface 906 of the handle 814 from rotating in one direction or the other around the pivot point 828. A pin in the upper holes 902 prevents the handle 814 from being upwardly lifted. A pin in the lower holes 914 prevents the handle 814 from being depressed downwardly.

The pin 828 around which the pinch bar 824 rotates functions as an axle. Upward or downward movement of the end of the handle 814, relative to horizontal, causes the wedge-shaped pinch bar 824 to translate toward or away from the third side of the U-shaped clamp section. The upward or downward handle movement thus pinches and un-pinches a plastic tube in the clamp section.

In a preferred embodiment, the handle 814 is formed of a stamped metal. The frame section is comprised of an injection molded plastic such as nylon or fiberglass. The clamp section 504 is also comprised of an injection molded plastic such as nylon or fiberglass. The heat transfer body or heat sink 606 is preferably comprised of a thermally-conductive material such as brass, copper or aluminum.

Those of ordinary skill in the art will recognize that the pinch valve described above has a valve frame that is open and capable of directly receiving a tube from a liquid reservoir without having to feed or "snake" the tube through a pinch bar assembly as prior art valves require. Moreover, the third side or back side of the frame section can be shaped with the side walls to provide a substantially concave shape which will locate a flexible tube directly in front of the pinch bar.

The heat sink or thermally conductive body being thermally and mechanically coupled to a heat transfer device such as those described above provides improved heat transfer over prior art devices. Such a feature assists in providing temperature stability to liquids trapped in a plastic tubing above the pinch valve keeping liquids therein hot or cold as necessary. Heat transfer through the thermally conductive body being by way of conduction rather than radiation or convection provides more thermal heat transfer than prior art pinch valves provide.

The foregoing description is for purposes of illustration only. The true scope of the invention is set forth in the appurtenant claims.

What is claimed is:

1. A pinch valve comprising:

a substantially U-shaped frame section comprising, opposing and spaced-apart first and second sides and a third side extending between and joining the first and second sides, the first and second sides having a clamp-receiving slot, the third side of the frame section comprising a thermally conductive body, which is coupled to a heat transfer device, the first, second and third sides defining a substantially U-shaped open passageway; and a clamp, configured to be removable from the substantially U-shaped frame section and configured to direct a pinching force toward the substantially U-shaped frame section.

2. The pinch valve of claim 1, wherein the removable clamp has first and second sides, the first side of the clamp having a protuberance configured to be received into the clamp-receiving slot in the first side of the frame section, the second side of the clamp having a protuberance configured to be received into the clamp-receiving slot in the second side of the frame section.

3. The valve of claim 2, wherein the protuberances are substantially cuboid shaped having a length, width and height, the clamp receiving slot having a width, a depth, first and second ends and a cutout at the second end, the width of the protuberances and the width of the slot being selected to provide a clearance fit between them, the cutout having a diameter and a depth selected to allow the cuboid-shaped protuberances to rotate inside the cutout.

4. The valve of claim 1, wherein the third side of the frame section is configured to receive a tube and to locate the tube at least near the center of the frame section.

5. The valve of claim 1, wherein the thermally-conductive body is comprised of a unitary block of metal having opposing first and second sides, the first side having a first channel, the second side having a second channel.

6. The valve of claim 1, wherein the clamp is comprised of a pinch bar and a lever configured to translate upwardly and downwardly relative to a lever rest position, upward and downward translation of the lever causing the pinch bar to translate away from the third side of the frame.

7. The valve of claim 6, wherein the pinch bar translates in first and second slots formed into the first and second sides of the clamp.

8. A liquid dispenser comprising:

a cabinet; and at least one valve, the at least one valve comprising:

a valve frame section comprising, opposing and spaced-apart first and second sides and having a third side extending between and joining the first and second sides, each of the first and second sides having a clamp-receiving slot, the first, second and third sides defining a tube-receiving passageway, the third side comprising a thermally conductive body coupled to a heat transfer device; and a clamp, which is removable from the valve frame section and configured to direct a pinching force toward the valve frame section, the clamp comprising first and second sides, the first and second sides of the clamp having a protuberance configured to be received into said clamp-receiving slot.

9. The valve of claim 8, wherein the thermally-conductive body is comprised of a unitary block of metal having opposing first and second sides, the first side having a first channel, the second side having a second channel.

10. The liquid dispenser of claim 8, wherein the clamp is comprised of a pinch bar and a lever configured to translate upwardly and downwardly relative to a lever rest position, both upward and downward translation around the axle relative to the rest position causing the pinch bar to translate away from the frame.

11. The liquid dispenser of claim 8, wherein the clamp is comprised of a pinch bar, a lever, and a lever stop pin, the lever and stop pin being configured to allow the clamp to translate only upwardly or only downwardly relative to a lever rest position, translation of the lever causing the pinch bar to translate away from the frame.

12. The valve of claim 10, wherein lever rotates around a substantially horizontal axis, translation of the lever between the first and second positions of the lever being in a vertical plane.

13. A pinch valve comprising:

a substantially U-shaped frame section comprising, opposing and spaced-apart first and second sides and a third side extending between and joining the first and second sides, the third side of the frame section comprising a thermally conductive body, which is coupled to a heat transfer device, the first, second and third sides defining a substantially U-shaped open passageway; and a clamp, configured to be removable from the substantially U-shaped frame section and configured to direct a pinching force toward the substantially U-shaped frame section.

* * * * *